US006260228B1

(12) United States Patent
Arroyo-Youngblood

(10) Patent No.: US 6,260,228 B1
(45) Date of Patent: Jul. 17, 2001

(54) HAND-HELD DEVICE FOR REMOVING LINT BALLS FROM A FABRIC

(76) Inventor: Aracelis Arroyo-Youngblood, 70 Clymer St., Apt. 6-B, Brooklyn, NY (US) 11211

( * ) Notice: Subject to any disclaimer, the term of this patent is extended or adjusted under 35 U.S.C. 154(b) by 0 days.

(21) Appl. No.: 09/498,965

(22) Filed: Feb. 7, 2000

(51) Int. Cl.[7] ..... A47L 25/08; A46B 1/00; A46B 7/04; A46B 9/02

(52) U.S. Cl. ..... 15/187; 15/104.001; 15/188; 15/176.1

(58) Field of Search ..... 15/104.001, 104.002, 15/176.1, 176.6, 186–188, 202

(56) References Cited

U.S. PATENT DOCUMENTS

| | | | | |
|---|---|---|---|---|
| 871,121 | * | 11/1907 | D'Humy | 15/188 X |
| 1,407,214 | * | 2/1922 | Osborn | 15/176.6 |
| 1,600,388 | * | 9/1926 | Barker | 15/186 |
| 1,797,946 | * | 3/1931 | Eichel | 15/188 X |
| 1,894,882 | * | 1/1933 | Mazzella | 15/176.6 |
| 1,957,591 | * | 5/1934 | Heckert | 15/104.001 X |
| 2,065,584 | * | 12/1936 | Hempel | 15/188 |
| 2,227,635 | * | 1/1941 | Dean | 15/176.1 |
| 3,129,448 | * | 4/1964 | Mittman | 15/187 X |
| 4,639,965 | * | 2/1987 | Suzuki | 15/104.002 |
| 4,850,073 | * | 7/1989 | Preuss | 15/104.001 X |
| 5,036,561 | | 8/1991 | Calafut | 15/105 |
| 5,435,328 | | 7/1995 | Grohoske | 132/120 |
| 5,742,969 | | 4/1998 | Thomas et al. | 15/104.002 |

FOREIGN PATENT DOCUMENTS

| | | | | |
|---|---|---|---|---|
| 2559656 | * | 8/1985 | (FR) | 15/176.1 |
| 294895 | * | 12/1928 | (GB) | 15/176.1 |
| 1405845 | * | 9/1975 | (GB) | 15/176.1 |
| 2138673 | * | 10/1984 | (GB) | 15/104.002 |
| 2163044 | * | 2/1986 | (GB) | 15/104.001 |

* cited by examiner

*Primary Examiner*—Mark Spisich
(74) *Attorney, Agent, or Firm*—Richard L. Miller, P.L.

(57) ABSTRACT

A hand-held device for removing lint balls from a fabric that includes a body, and a pad. The body is fork-shaped and includes a handle, and bifurcations that extend longitudinally from the handle. The bifurcations have grooves that extend longitudinally therein, and the handle has a groove that extends transversely thereacross and communicates with the grooves in the bifurcations so as to form a generally U-shaped channel. The body further includes a plate that extends from one bifurcation to the other bifurcation and provides rigidity for the pad. The pad is a layer of flexible material that is snugly, slidably, and selectively disposed in the generally U-shaped channel. The exterior surface of the layer of flexible material is covered with prongs that function similarly to hooks of a hook and loop fastener for engaging and removing the lint balls from the fabric when brushed thereacross. The prongs run in rows that extend laterally thereacross and diagonally upwardly toward the bifurcations, with adjacent rows thereof facing in opposite directions.

10 Claims, 1 Drawing Sheet

FIG.1
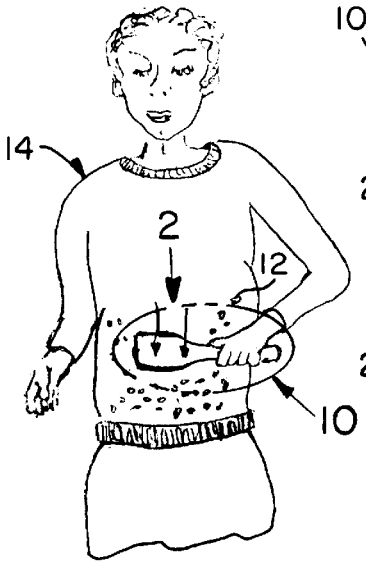
FIG.2
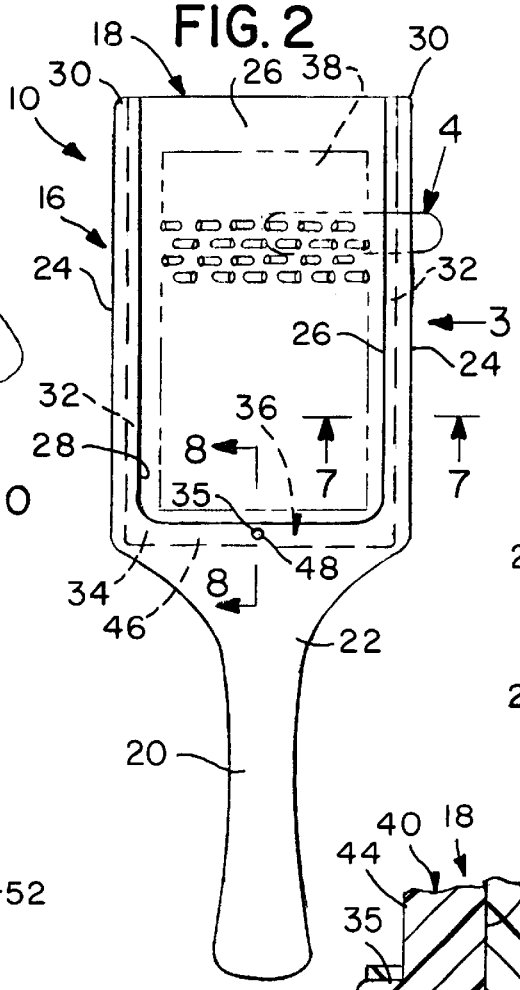
FIG.3
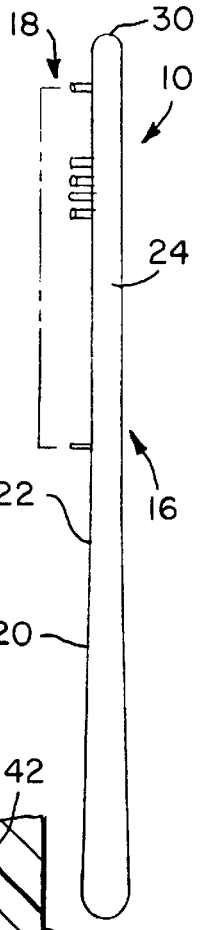
FIG.4
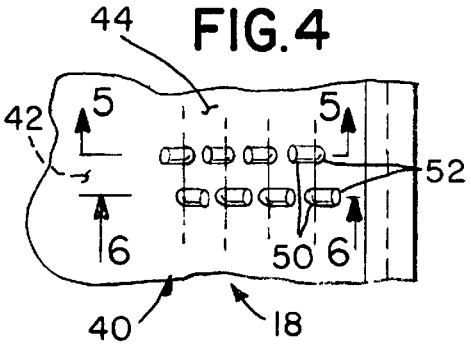
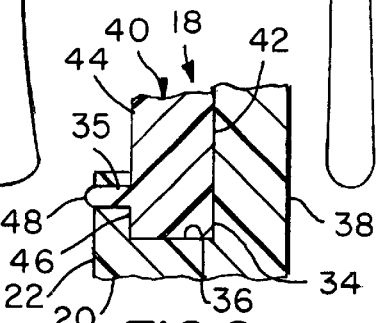
FIG.8
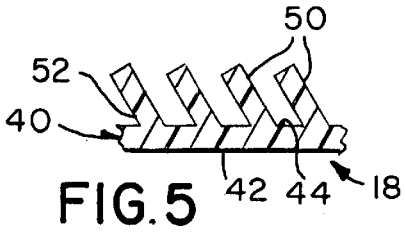
FIG.5
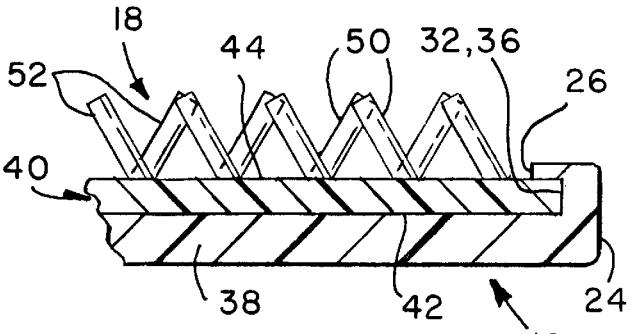
FIG.7
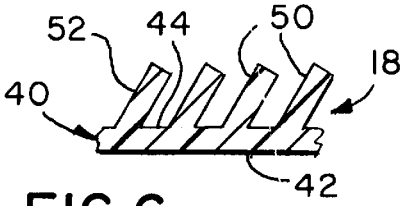
FIG.6

HAND-HELD DEVICE FOR REMOVING LINT BALLS FROM A FABRIC

BACKGROUND OF THE INVENTION

1. Field of the Invention

The present invention relates to a hand-held device. More particularly, the present invention relates to a hand-held device for removing lint balls from a fabric.

2. Description of the Prior Art

Numerous innovations for lint removers have been provided in the prior art that will be described. Even though these innovations may be suitable for the specific individual purposes to which they address, however, they differ from the present invention.

A FIRST EXAMPLE, U.S. Pat. No. 5,036,561 to Calafut teaches a device for removing fiber pills and lint from a fabric in which a supporting substrate has affixed on one surface an abrasive coating of substantially uniform particles lying in the range of 280–600 grit size for removing pills and on another surface a fabric with a slant, hook or loop pile to remove lint. The device can be a pliant foam sheet with abrasive-coated film and fabric pile on opposite surfaces or a heavier brushlike implement having those two surfaces.

A SECOND EXAMPLE, U.S. Pat. No. 5,435,328 to Grohoske teaches a multi-purpose toiletry article which comprises: a long, rigid, plastic handle; a preferably oval rigid, plastic support head mounted in fixed or pivotal relationship at one end of such handle; and a removable fastener to removably and interchangeably affix one of a multiple of oval working members to said oval support head.

A THIRD EXAMPLE, U.S. Pat. No. 5,742,969 to Thomas et al. teaches a particle removing device that is formed as a thin flexible generally flat loop sheet, with a layer of adhesive covering one sheet face while the other face is substantially plain, and a quick release backer sheet covers the adhesive layer on the loop sheet prior to use. The particle removing device is reconfigured from its flat storage condition to a three-dimensional loop use configuration, with the adhesive layer exposed and on the outside face of the loop, by peeling off the backer sheet to expose the underlying adhesive layer and curling the loop sheet on itself to connect its opposite ends together at a small lapped connection area. The user can then fit his/her open hand into the loop to pat or roll the loop adhesive layer against or along the surface to be cleaned.

It is apparent that numerous innovations for lint removers have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a hand-held device for removing lint balls from a fabric that avoids the disadvantages of the prior art.

ANOTHER OBJECT of the present invention is to provide a hand-held device for removing lint balls from a fabric that is simple and inexpensive to manufacture.

STILL ANOTHER OBJECT of the present invention is to provide a hand-held device for removing lint balls from a fabric that is simple to use.

BRIEFLY STATED, YET ANOTHER OBJECT of the present invention is to provide a hand-held device for removing lint balls from a fabric that includes a body, and a pad. The body is fork-shaped and includes a handle, and bifurcations that extend longitudinally from the handle. The bifurcations have grooves that extend longitudinally therein, and the handle has a groove that extends transversely thereacross and communicates with the grooves in the bifurcations so as to form a generally U-shaped channel. The body further includes a plate that extends from one bifurcation to the other bifurcation and provides rigidity for the pad. The pad is a layer of flexible material that is snugly, slidably, and selectively disposed in the generally U-shaped channel. The exterior surface of the layer of flexible material is covered with prongs that function similarly to hooks of a hook and loop fastener for engaging and removing the lint balls from the fabric when brushed thereacross. The prongs run in rows that extend laterally thereacross and diagonally upwardly toward the bifurcations, with adjacent rows thereof facing in opposite directions.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic front elevational view of the present invention in use;

FIG. 2 is an enlarged diagrammatic bottom plan view of the area generally enclosed in the dotted curve identified by arrow 2 in FIG. 1 of the present invention;

FIG. 3 is a diagrammatic side elevational view taken generally in the direction of arrow 3 in FIG. 2;

FIG. 4 is an enlarged fragmented bottom plan view of the area generally enclosed in the dotted curve identified by arrow 4 in FIG. 2;

FIG. 5 is an enlarged diagrammatic cross sectional view taken on line 5—5 in FIG. 4;

FIG. 6 is an enlarged diagrammatic cross sectional view taken on line 6—6 in FIG. 4;

FIG. 7 is an enlarged diagrammatic cross sectional view taken on line 7—7 in FIG. 2; and FIG. 8 is an enlarged diagrammatic cross sectional view taken on line 8—8 in FIG. 2.

LIST OF REFERENCE NUMERALS UTILIZED IN THE DRAWING

10 hand-held device for removing lint balls 12 from fabric 14
12 lint balls on fabric 14
14 fabric
16 body for holding in hand
18 pad for engaging and removing lint balls 12 from fabric 14 when brushed thereacross
20 handle of body 16 for holding in hand
22 end of handle 20 of body 16
24 bifurcations of body 16
26 space of body 16 separating bifurcations 24 of body 16 from each other
28 faces of bifurcations 24 of body 16
30 free ends of bifurcations 24 of body 16

32 grooves in bifurcations 24 of body 16
34 groove in end 22 of handle 20 of body 16
35 blind bore 35 extending centrally in end 22 of handle 20 of body 16
36 generally U-shaped channel in body 16
38 plate of body 16
40 layer of flexible material 40 of pad 18
42 interior surface of layer of flexible material 40 of pad 18
44 exterior surface of layer of flexible material 40 of pad 18
46 lowermost edge of exterior surface 44 of layer of flexible material 40 of pad 18
48 bump on lowermost edge 46 of exterior surface 44 of layer of flexible material 40 of pad 18
50 prongs covering exterior surface 44 of layer of flexible material 40 of pad 18 for engaging and removing lint balls 12 from fabric 14
52 rows of prongs 50 covering exterior surface 44 of layer of flexible material 40 of pad 18

DETAILED DESCRIPTION OF THE PREFERRED EMBODIMENT

Referring now to the figures, in which like numerals indicate like parts, and particularly to FIG. 1, the hand-held device of the present invention is shown generally at 10 for removing lint balls 12 from a fabric 14.

The overall configuration of the hand-held device 10 can best be seen in FIGS. 2 and 3, and as such, will be discussed with reference thereto.

The hand-held device 10 comprises a body 16 for holding in a hand, and a pad 18 that is mounted to the body 16 for engaging and removing the lint balls 12 from the fabric 14 when brushed thereacross.

The specific configuration of the body 16 can best be seen in FIGS. 2 and 3, and as such, will be discussed with reference thereto.

The body 16 is fork-shaped and comprises a handle 20 for holding in the hand, and which terminates in an end 22, and bifurcations 24 that extend longitudinally from the end 22 of the handle 20 of the body 16, are separated by a space 26, have faces 28 that face each other with lengths, and have free ends 30.

Both the handle 20 of the body 16 and the bifurcations 24 of the body 16 are slender and elongated.

The bifurcations 24 of the body 16 have grooves 32 that extend longitudinally in the lengths of the faces 28 thereof, from the handle 20 of the body 16 to, and opens into, the free ends 30 of the bifurcations 24 of the body 16.

The end 22 of the handle 20 of the body 16 has a groove 34 that extends transversely thereacross and communicates with the grooves 32 in the bifurcations 24 of the body 16 so as to form a generally U-shaped channel 36, and a blind bore 35 that extends centrally therein and communicates with the groove 34 therein.

The body 16 further comprises a plate 38 that extends from one bifurcation 24 of the body 16 to the other bifurcation 24 of the body 16, lies in a plane, fills the space 26 between the bifurcations 24 of the body 16, is disposed parallel to, and slightly below, the generally U-shaped channel 36 in the body 16, and provides rigidity for the layer of flexible material 40 during use.

The specific configuration of the pad 18 and its interface with the body 16 can best be seen in FIGS. 4–8, and as such, will be discussed with reference thereto.

The pad 18 is a layer of flexible material 40 that is snugly, slidably, and selectively disposed in the generally U-shaped channel 36 in the body 16, from the free ends 30 of the bifurcations 24 of the body 16.

The layer of flexible material 40 has an interior surface 42 that abuts against the plate 38 of the body 16 when the layer of flexible material 40 is disposed in the generally U-shaped channel 36 in the body 16, and an exterior surface 44 that is disposed oppositely to the interior surface 42 of the layer of flexible material 40 and has a lowermost edge 46.

The lowermost edge 46 of the exterior surface 44 of the layer of flexible material 40 has a bump 48 that is resilient and selectively and snapingly engages in the blind bore 35 in the end 22 of the handle 20 of the body 16.

When the bump 48 on the lowermost edge 46 of the exterior surface 44 of the layer of flexible material 40 is engaged in the blind bore 35 in the end 22 of the handle 20 of the body 16, the pad 18 is maintained in the body 16.

When the bump 48 on the lowermost edge 46 of the exterior surface 44 of the layer of flexible material 40 is snapped out of the blind bore 35 in the end 22 of the handle 20 of the body 16, the pad 18 is removable.

The exterior surface 44 of the layer of flexible material 40 is covered with prongs 50 that function similarly to hooks of a hook and loop fastener for engaging and removing the lint balls 12 from the fabric 14.

The prongs 50 on the exterior surface 44 of the layer of flexible material 40 run in rows 52 that extend laterally thereacross, from one bifurcation 24 of the body 16 to the other bifurcation 24 of the body 16.

The prongs 50 on the exterior surface 44 of the layer of flexible material 40 extend diagonally upwardly toward the bifurcations 24 of the body 16, with adjacent rows 52 thereof facing in opposite directions.

It will be understood that each of the elements described above, or two or more together, may also find a useful application in other types of constructions differing from the types described above.

While the invention has been illustrated and described as embodied in a hand-held device for removing lint balls from a fabric, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hand-held device for removing lint balls from a fabric, comprising:

a) a body for holding in a hand; and b) a pad mounted to said body for engaging and removing the lint balls from the fabric when brushed thereacross, wherein said body is fork-shaped and comprises a handle for holding in the hand, and which terminates in an end wherein said body further comprises bifurcations that extend longitudinally from said of said handle of said body, are separated by a space, have faces that face each other with lengths, and have free ends, wherein said bifurcations of said body have grooves that extend longitudinally in said lengths of said faces thereof, from said handle of said body to, and opens into, said free ends of said bifurcations of said body, wherein said end of said handle of said body has a groove that extends transversely thereacross and communicates with said grooves in said bifurcations of said body so as to form a generally U-shaped channel, wherein said end of said handle of said body has a blind bore that extends centrally therein and communicates with said groove therein.

2. The device as defined in claim 1, wherein both said handle of said body and said bifurcations of said body are slender and elongated.

3. The device as defined in claim 1, wherein said body further comprises a plate that extends from one bifurcation of said body to the other bifurcation of said body, lies in a plane, fills said space between said bifurcations of said body, is disposed parallel to, and slightly below, said generally U-shaped channel in said body, and provides rigidity for said pad during use.

4. The device as defined in claim 3, wherein said pad is a layer of flexible material that is snugly, slidably, and selectively disposed in said generally U-shaped channel in said body, from said free ends of said bifurcations of said body.

5. The device as defined in 4, wherein said layer of flexible material has an interior surface that abuts against said plate of said body when said layer of flexible material is disposed in said generally U-shaped channel in said body.

6. The device as defined in claim 5, wherein said layer of flexible material further has an exterior surface that is disposed oppositely to said interior surface of said layer of flexible material, and has a lowermost edge.

7. The device as defined in claim 6, wherein said lowermost edge of said exterior surface of said layer of flexible material has a bump that is resilient and selectively and snapingly engages in said blind bore in said end of said handle of said body, and when said bump on said lowermost edge of said exterior surface of said layer of flexible material is engaged in said blind bore in said end of said handle of said body, said pad is maintained in said body, and when said bump on said lowermost edge of said exterior surface of said layer of flexible material is snapped out of said blind bore in said end of said handle of said body, said pad is removable.

8. The device as defined in claim 6, wherein said exterior surface of said layer of flexible material is covered with prongs that function similarly to hooks of a hook and loop fastener for engaging and removing the lint balls from the fabric.

9. The device as defined in claim 8, wherein said prongs on said exterior surface of said layer of flexible material run in rows that extend laterally thereacross, from one bifurcation of said body to the other bifurcation of said body.

10. The device as defined in claim 9, wherein said prongs on said exterior surface of said layer of flexible material extend diagonally upwardly toward said bifurcations of said body, with adjacent rows thereof facing in opposite directions.

* * * * *